US010480387B2

(12) United States Patent
Denis et al.

(10) Patent No.: US 10,480,387 B2
(45) Date of Patent: Nov. 19, 2019

(54) HOUSING FOR AFTERTREATMENT SYSTEMS

(71) Applicant: Caterpillar Inc., Peoria, IL (US)

(72) Inventors: Andrew M. Denis, Peoria, IL (US); Zhang Zhenhua, Wuxi (CN); Min Xiao, Wuxi (CN); Julian Justin, Peoria, IL (US); Jun Zuo, Edwards, IL (US)

(73) Assignee: Caterpillar Inc., Peoria, IL (US)

( * ) Notice: Subject to any disclaimer, the term of this patent is extended or adjusted under 35 U.S.C. 154(b) by 159 days.

(21) Appl. No.: 15/427,104

(22) Filed: Feb. 8, 2017

(65) Prior Publication Data

US 2018/0223719 A1 Aug. 9, 2018

(51) Int. Cl.

| | |
|---|---|
| ***F01N 13/18*** | (2010.01) |
| ***F01N 3/20*** | (2006.01) |
| ***F01N 13/00*** | (2010.01) |
| *F01N 3/10* | (2006.01) |
| *F01N 3/021* | (2006.01) |

(52) U.S. Cl.

CPC ..... *F01N 13/1888* (2013.01); *F01N 13/0097* (2014.06); *F01N 13/1805* (2013.01); *F01N 13/1838* (2013.01); *F01N 13/1844* (2013.01); *F01N 13/1872* (2013.01); *F01N 3/021* (2013.01); *F01N 3/103* (2013.01); *F01N 3/2066* (2013.01); *F01N 2530/00* (2013.01)

(58) Field of Classification Search

CPC ..... F01N 13/1888; F01N 13/1805; F01N 13/1838; F01N 13/1844; F01N 13/1872; F01N 3/021; F01N 3/103; F01N 3/2066

USPC ..... 60/272

See application file for complete search history.

(56) References Cited

U.S. PATENT DOCUMENTS

| | | | | |
|---|---|---|---|---|
| 2,126,949 | A * | 8/1938 | Ditchfield | B65D 90/60 105/283 |
| 4,958,491 | A * | 9/1990 | Wirth | F01N 3/2853 422/179 |
| 8,066,792 | B2 | 11/2011 | Wadke et al. | |
| 9,140,160 | B2 | 9/2015 | Hehle et al. | |
| 2014/0174060 | A1* | 6/2014 | Baig | F01N 3/2839 60/299 |
| 2015/0132191 | A1* | 5/2015 | Sindle | F01N 3/0892 422/168 |
| 2015/0233089 | A1* | 8/2015 | Kamimae | E02F 9/0866 180/309 |

* cited by examiner

*Primary Examiner* — Laert Dounis
*Assistant Examiner* — Kelsey L Stanek
(74) *Attorney, Agent, or Firm* — Oblon, McClelland, Maier & Neustadt

(57) ABSTRACT

A housing for an aftertreatment system is disclosed. The housing includes a wall that defines an interior cavity. The interior cavity is configured to enclose at least one aftertreatment component. Moreover, the wall has at least one corrugated panel having alternating grooves and ridges.

15 Claims, 7 Drawing Sheets

HOUSING FOR AFTERTREATMENT SYSTEMS

TECHNICAL FIELD

The present disclosure relates to a housing for an aftertreatment system, and, more particularly, relates to such a housing with one or more walls having integrated stiffeners.

BACKGROUND

Aftertreatment systems in fossil fuel powered combustion engines, such as diesel engines (or simply engines), are well known to treat a quantity of exhaust gas released by the engine. When an aftertreatment system is applied in large-scale applications, such as a marine application for example, a size of the aftertreatment system used may be relatively large. Such relatively large sized aftertreatment systems are usually packed into a housing for space efficiency, easy assembly, and easy service. Such housings may enclose one or more aftertreatment components, such as catalysts, of the aftertreatment system.

Large-scale industrial applications generally include commensurately large sized combustion engines as well, and which may operate under arduous work cycles. An operation of such engines may produce intolerably large pressure waves and pulsations because of their firing frequency. Such large pressure waves, pulsations, and/or resulting vibrations, may lead to fatigue, deformation, and even failure of certain components surrounding the engine, with one such component being the housing. If vibrations remain unchecked, failures and costly outages to the housing may follow. To prevent such failures, housings are known to be provided with reinforcements. For example, it is known to add support skins, such as in the form of outer walls, to the housing's walls, and in certain cases, angled rods, such as those including a C-shaped cross-section are attached to the walls to protect the walls against the effects of pulsation. A procedure to add the reinforcements to the walls is generally laborious and time consuming since it may involve one or more of welding, riveting, and bolting of the reinforcements to the walls. Moreover, a procurement of the reinforcements itself is a costly affair.

U.S. Pat. No. 9,140,160 relates to exhaust gas after treatment units. The after treatment units include an encapsulated design that is constructed in a modular manner from disk-shaped components. The disk-shaped components are surrounded by frames that are consecutively and elastically clamped to each other, transverse to a disk plane.

SUMMARY OF THE INVENTION

In one aspect, the disclosure is directed towards a housing for an aftertreatment system. The housing includes a wall that defines an interior cavity. The inner cavity is configured to enclose at least one aftertreatment component. Further, the wall includes at least one corrugated panel having alternating grooves and ridges.

In another aspect, the disclosure relates to an aftertreatment system for an engine. The aftertreatment system includes at least one aftertreatment component. Further, the aftertreatment system includes a housing that is configured to house the aftertreatment component. Moreover, the housing includes a wall defining an interior cavity. The interior cavity is configured to enclose the aftertreatment component. Further, the wall has at least one corrugated panel.

In yet another aspect, the disclosure is directed towards an engine system. The engine system includes an aftertreatment system configured to receive exhaust gas from an engine. The aftertreatment system includes at least one aftertreatment component and a housing that is configured to house the aftertreatment component. Further, the housing includes a wall that defines an interior cavity configured to enclose the aftertreatment component. Moreover, the wall has at least one corrugated panel.

DETAILED DESCRIPTION

Figure 1:
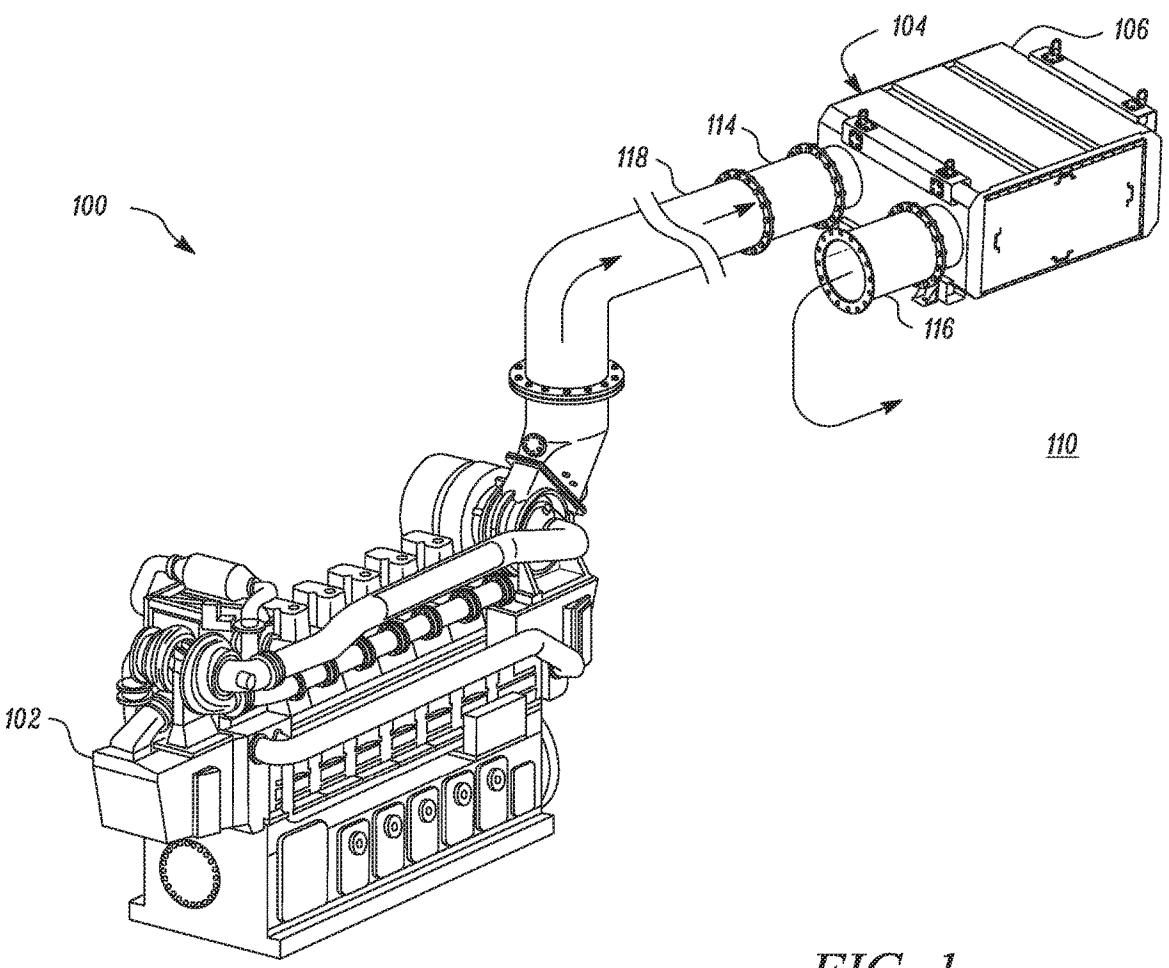
FIG. 1 is a diagrammatic view of an exemplary engine system having an engine and an aftertreatment system, in accordance with the concepts of the present disclosure.

Referring to FIG. 1, there is shown an engine system 100. The engine system 100 may include an internal combustion engine (or simply an engine 102) and an aftertreatment system 104. The aftertreatment system 104 may be coupled to the engine 102 to receive and treat a quantity of exhaust gas from the engine 102. In one implementation, the engine system 100 may be applicable in large-scale industrial applications. For example, the engine system 100 may be applicable in marine vessels. Certain aspects of the present disclosure may also be applied to construction machines, such as off-highway trucks, loaders, tractors, excavators, dozers, loaders, compactors, etc. Further, use of one or more of these aspects may also be extended to stationary machines, such as power generation systems and other electric power generating machines. Although the present disclosure contemplates the employment of a multi-cylinder diesel engine, as the engine 102, aspects of the present disclosure need not be limited to any engine type. Reference will now be made in detail to the embodiments of the present disclosure, examples of which are illustrated in the accompanying drawings. Wherever possible, the same reference numbers are used in the drawings and the description to refer to the same or like parts.

Figure 2:
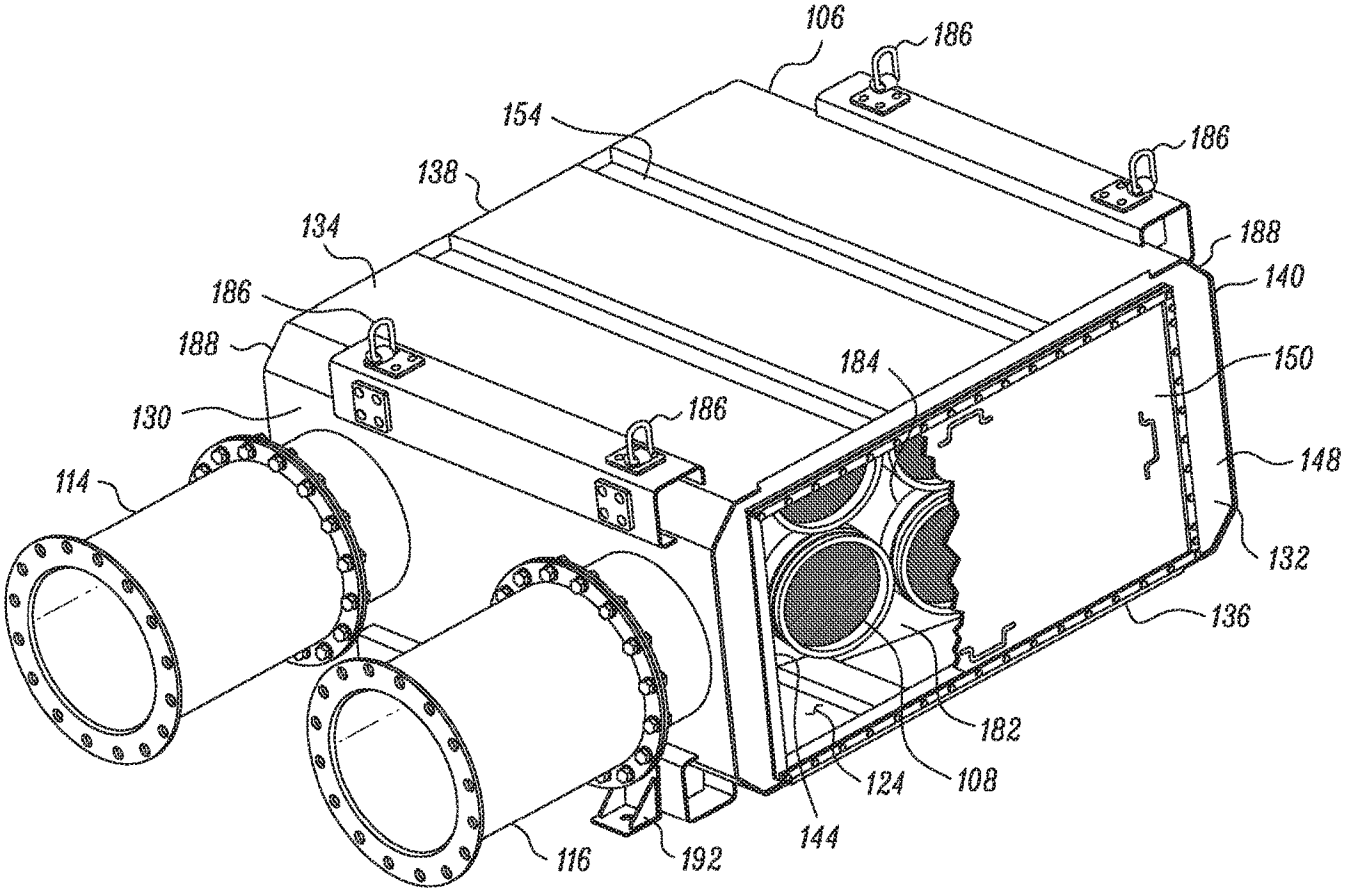
FIG. 2 is an exemplary housing that houses one or more aftertreatment components of the aftertreatment system of FIG. 1, in accordance with the concepts of the present disclosure.

Referring to FIG. 2, the aftertreatment system 104 may be applied for treating exhaust gas released from the engine 102, as already noted. In this regard, the aftertreatment system may include a housing 106 and at least one aftertreatment component (referred to as component 108, see FIG. 2) housed within the housing 106. The component 108 is configured to receive and process the exhaust gas, before venting out the exhaust gas into an environment 110. The component 108 may represent and/or include one or more of a Selective Catalytic Reduction Catalyst (referred to as an SCR catalyst) that may convert nitrogen oxides in the exhaust gas into diatomic nitrogen and water; a Diesel Oxidation Catalyst (referred to as a DOC) that may oxidize the hydrocarbons and carbon monoxide of the exhaust gas into carbon dioxide and water; and/or a Diesel Particulate Filter (referred to as a DPF) that may filter or separate soot or diesel particulate matter from the inflowing exhaust gas. Each of these components (i.e. represented by component 108) may be assembled and housed within the housing 106 according to a general practice of the art. In some implementations, a cleanup catalyst (e.g., an ammonia adsorbing catalyst—AMOx catalyst), which may facilitate a treatment of the exhaust gas prior to an emission of the exhaust gas into the environment 110, may also be applied as the component 108. It is also possible that the component 108 includes and/or represents other similar types of components or catalysts of the art that are used to convert, reduce, trap, remove, or otherwise condition, constituents of the exhaust gas, produced by engine 102.

Figure 3:
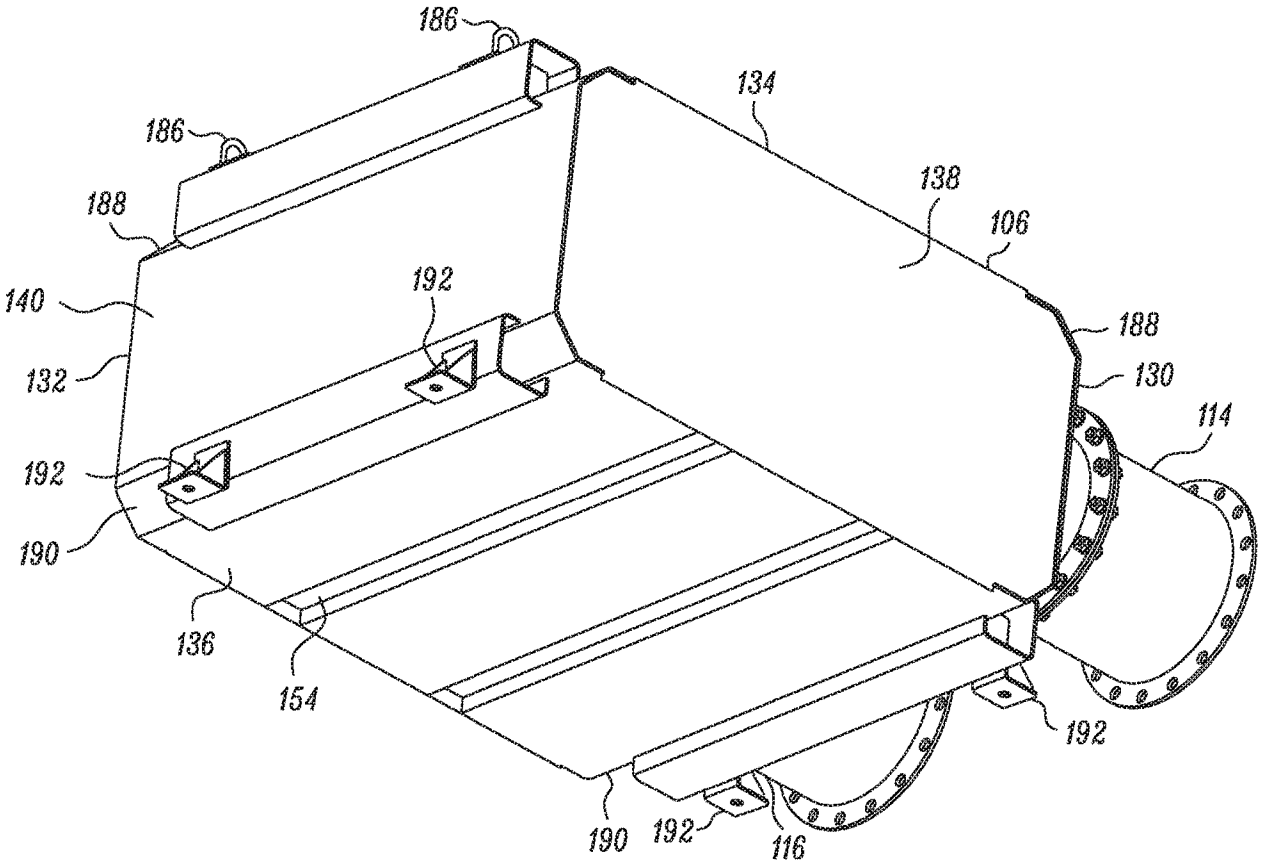
FIG. 3 is a bottom view of the housing of FIG. 2.

Referring to FIGS. 1, 2, and 3, the housing 106 may include an inlet 114 to receive the exhaust gas, and an outlet 116 to release a treated quantity of the exhaust gas to the environment 110. In some implementations, the aftertreatment system 104 may include an exhaust conduit 118 fluidly coupled between the inlet 114 and the engine 102, that allows the component 108 (FIG. 2) to be exposed to the exhaust gas from the engine 102. Further, the housing 106 may include an interior cavity 124 that is configured to enclose the component 108. In some implementations, the housing 106 facilitates placement of multiple other elements of the aftertreatment system 104, such as tubing, conduits, reservoirs, such as for reductants, etc., that are associated with the aftertreatment system 104. However, these elements have neither been shown, nor are they described any further, to maintain clarity and simplicity of the discussions related to the aspects of the present disclosure.

Referring to FIGS. 2 and 3, the housing 106 may be box-shaped (or cuboidal-shaped) as shown, inclusive of a number of sides. For example, the housing 106 may include six sides. Each side may include a sidewall, referred to as a wall. Given six sides, the housing 106 may include six walls—a first wall 130, a second wall 132, a third wall 134, a fourth wall 136, a fifth wall 138, and a sixth wall 140. The first wall 130 may include and/or accommodate both the inlet 114 and the outlet 116. The second wall 132 may be adjacent and perpendicularly formed to the first wall 130, and may include an opening 144 that allows the component 108 to be inserted, retrieved, and/or accessed, during assembly or service. The second wall 132 may include a frame 148 and a door panel 150. The frame 148 may be formed around the opening 144, as shown, and the door panel 150 may be configured to close the opening 144 during engine operations. A closure of the opening 144 may be performed by bolting the door panel 150 to the frame 148. Further, the third wall 134 and the fourth wall 136 may extend parallelly at right angles from the first wall 130 and the second wall 132. The fifth wall 138 may be opposite to the second wall 132, disposed at right angles to each of the first wall 130, the third wall 134, and the fourth wall 136. Furthermore, the sixth wall 140 of the housing 106 may be opposite to the first wall 130, and may be disposed at right angles to each of the second wall 132, the third wall 134, the fourth wall 136, and the fifth wall 138. Each of these walls 130, 132, 134, 136, 140 define the interior cavity 124 of the housing 106.

Figure 4:
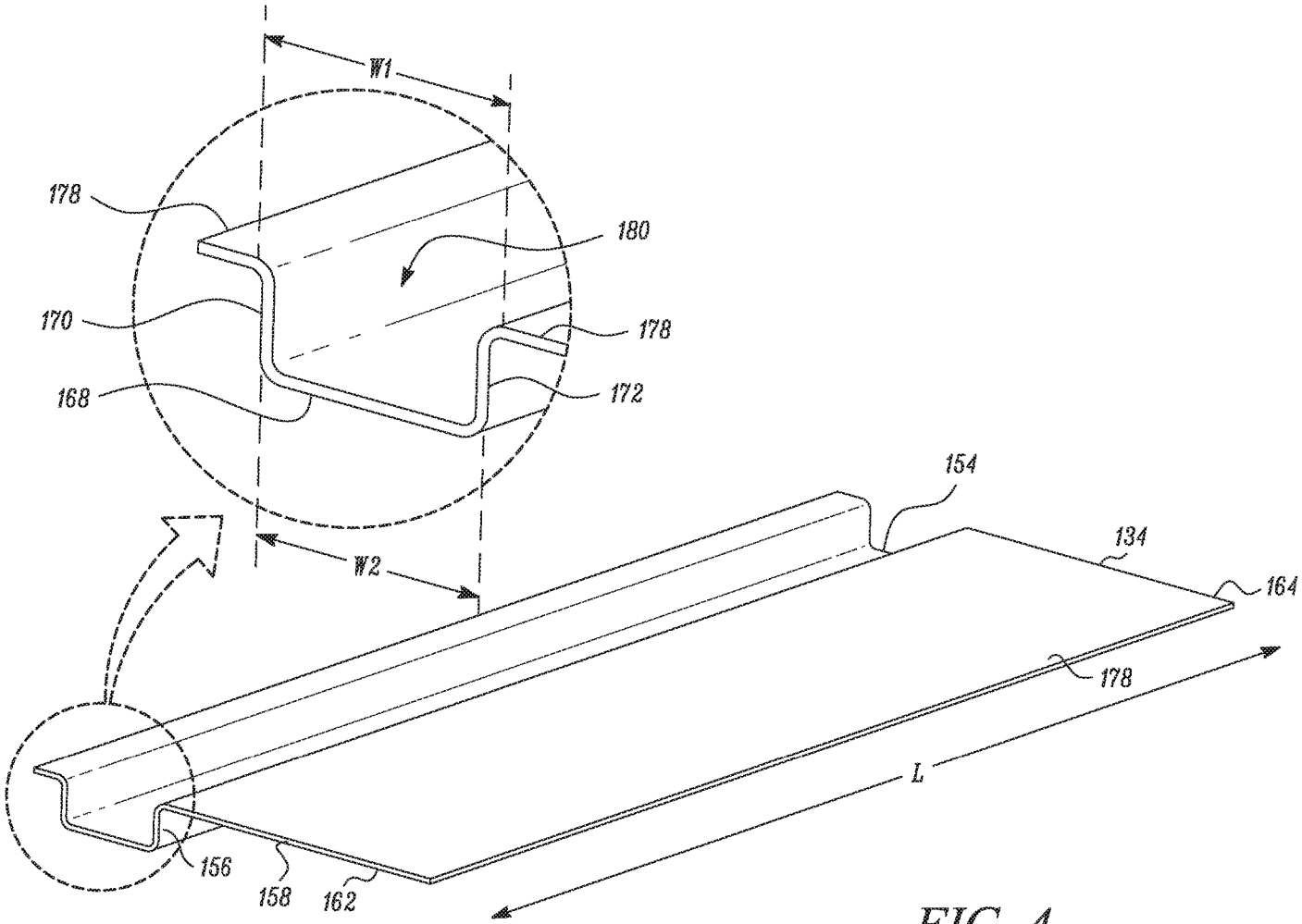
FIG. 4 is a wall of the housing with certain surrounding components removed, in accordance with the concepts of the present disclosure.

Referring to FIG. 4, a structure of the third wall 134 and the fourth wall 136 will now be discussed. While a position of the third wall 134 may differ from a position of the fourth wall 136 (i.e. although the third wall 134 may be opposite to the fourth wall 136 when assembled to form the housing 106), a structure, dimension, and size, of the third wall 134 may be similar to the fourth wall 136. For simplicity, therefore, the forthcoming discussion may include references to the third wall 134 alone. It will be understood that these reference cover and are equivalently applicable to a structure of the fourth wall 136 as well.

The third wall 134 may be formed from a single, planarly formed sheet metal. The sheet metal may be of a suitable thickness, but which may depend upon a size of the housing 106. The third wall 134 may include at least one corrugated panel 154 having alternating grooves 156 and ridges 158. The corrugated panel 154 may run along one of a length, L, or a breadth of the third wall 134. In an embodiment, the corrugated panel 154 runs throughout the length, L, of the third wall 134, from a first edge 162 of the third wall 134 to an opposite, second edge 164 of the third wall 134, as shown. In one example, the corrugated panel 154 is integrally formed with the third wall 134. For example, a bending operation using a press brake machine tool may be applied to form such an integrated, corrugated panel 154, and such bending operations being known to those of skill in the art. Each alternating groove 156 of the corrugated panel 154 may be U-shaped including a base wall 168 and a pair of side walls (a first side wall 170 and a second side wall 172), and each alternating ridge 158 of the corrugated panel 154 may include a raised wall 178 spaced apart from the base wall 168. Further, the base wall 168 may be parallel to the raised wall 178 and the pair of side walls 170, 172 may be at right angles to each of the base wall 168 and the raised wall 178. Therefore, each alternating groove 156 of corrugated panel 154 may include a rectangular cross-section. In an embodiment, each alternating groove 156 may define a mouth 180 formed between the pair of side walls 170, 172 (and/or two successive raised walls 178), and given the rectangular cross-section of each alternating groove 156, a width, $W_1$, of the mouth 180 may be dimensionally equal to a width, $W_2$, of the base wall 168.

For accommodating and assembling the component 108 (or one or more components) within the housing 106, the housing 106 may include a plate 182 (see FIG. 2) with may include one or more apertures 184, with each aperture 184 receiving one component 108. The plate 182 may be coupled to the third wall 134 and the fourth wall 136 by welding, although it is possible that the third wall 134 and the fourth wall 136 be coupled to the plate 182 in an alternative fashion, such as by bolting, riveting, or by other conventional fastening means. Further, the housing 106 may include one or more lift hooks 186 coupled to edges 188 of the housing 106. For example, such edges 188 may be formed at respective interface where the third wall 134 meets the first wall 130 and the sixth wall 140. Similarly, edges 190 may be formed at respective interfaces where the fourth wall 136 meets the first wall 130 and the sixth wall 140 (see FIG. 3). One or more mounting brackets 192 may be coupled to the edges 190, and which help mount the housing 106 over a platform (not shown), for example.

Figure 5:
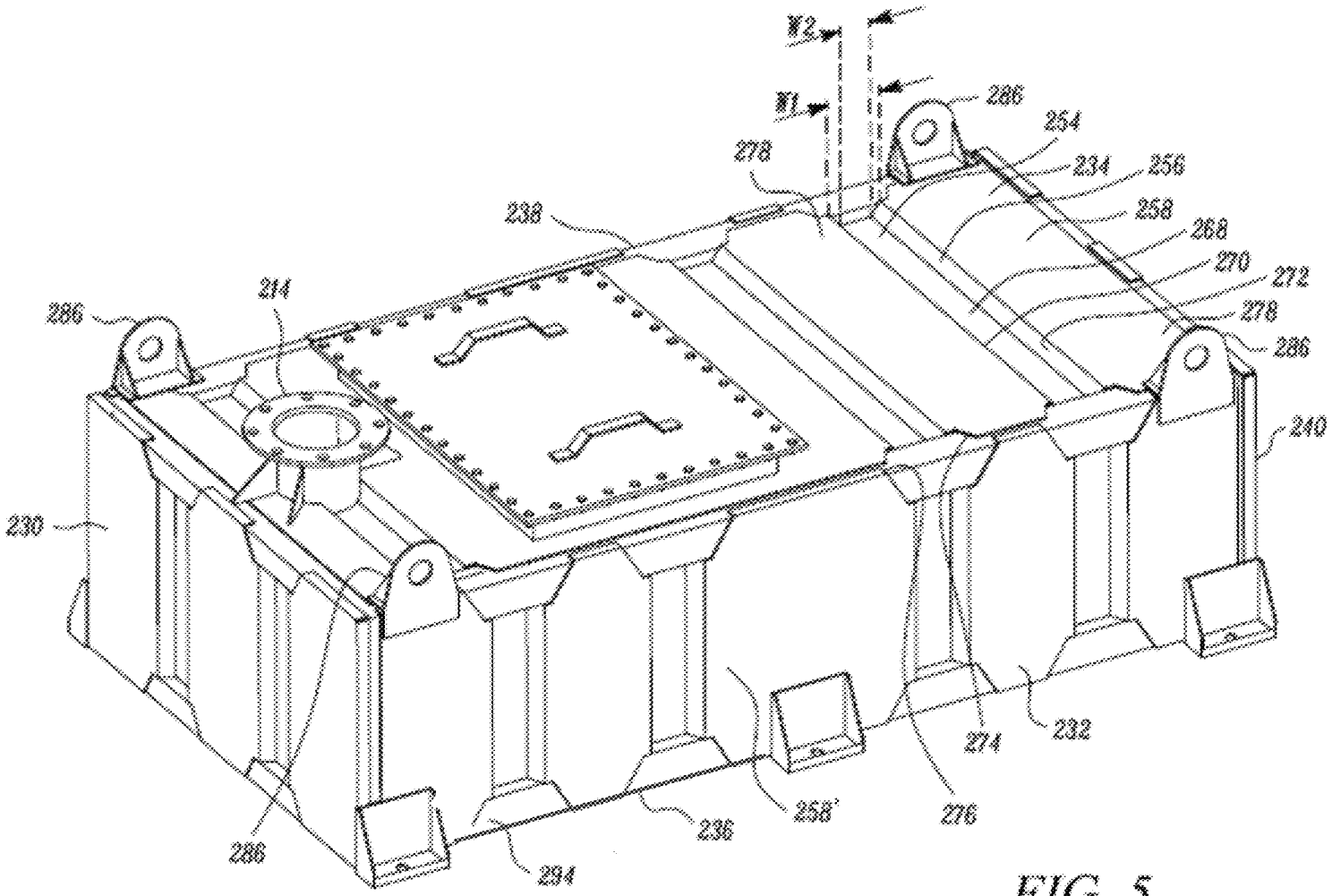
FIG. 5 is an embodiment of the housing, in accordance with the concepts of the present disclosure.
Figure 6:
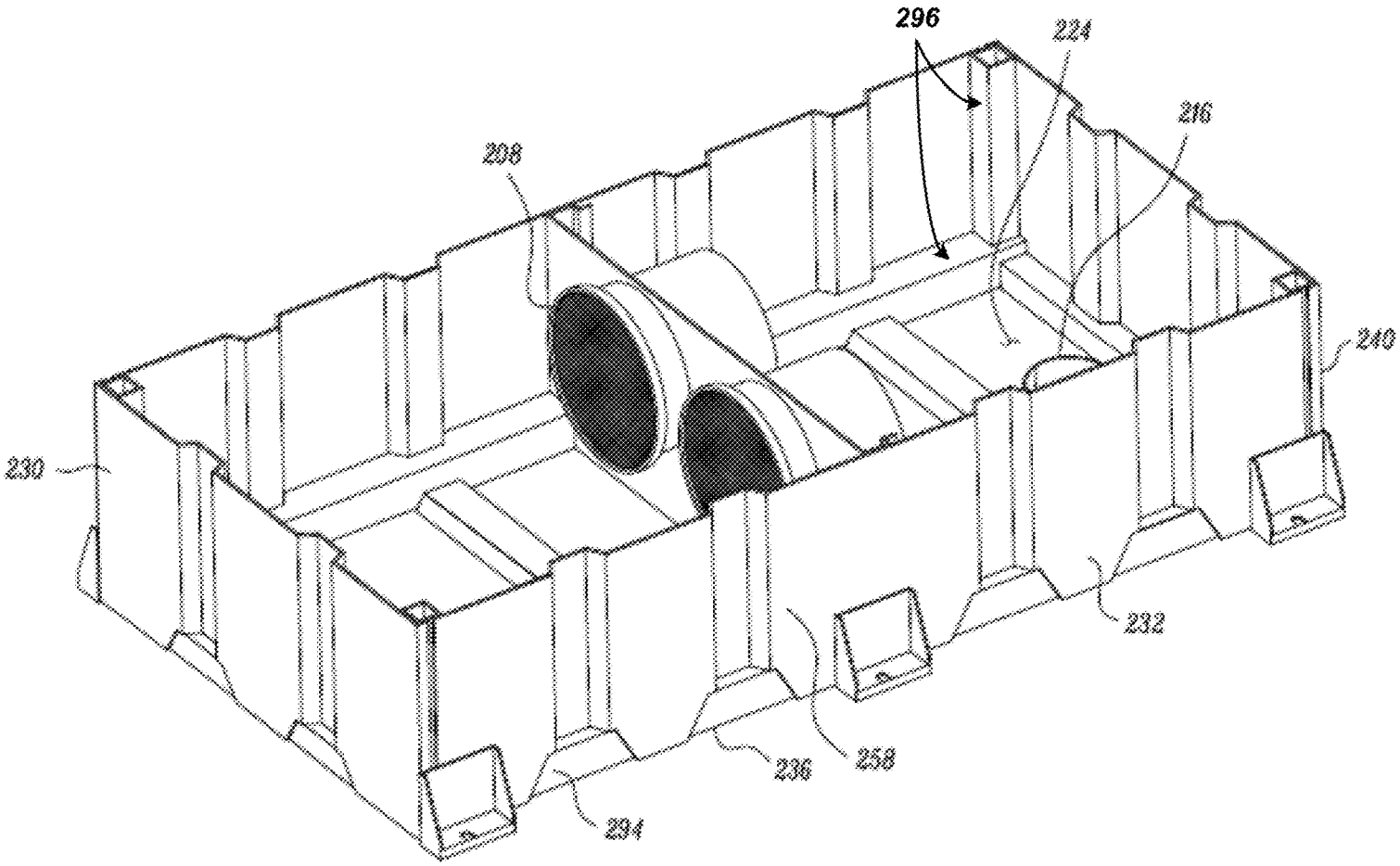
FIG. 6 is the embodiment of the housing depicted in FIG. 6, with a portion of the housing removed to depict an interior cavity of the housing, in accordance with the concepts of the present disclosure.

Referring to FIGS. 5 and 6, a housing 206, similar to the housing 106, is depicted and discussed. As with the housing 106, the housing 206 may also include a box-shaped (or cuboidal-shaped) structure, having a first wall 230, a second wall 232, a third wall 234, a fourth wall 236, a fifth wall 238, and a sixth wall 240. With reference to FIG. 6, the housing 206 is shown with the third wall 234 removed, and an interior space 224 of the housing 206 shown. An arrangement of each of the walls 230, 232, 234, 236, 238, 240 may remain similar to and correspond to the arrangement of the walls 130, 132, 134, 136, 138, 140. However, the housing 206 may have an inlet 214 for the exhaust gas provided in the third wall 234, and an outlet 216 for the exhaust gas provided in the fourth wall 236, unlike the positions of the inlet 114 and outlet 116 of the housing 106. Further, similar to the component 108, the housing 206 may be configured to house and/or enclose a component 208, as shown. As has been discussed for the third wall 134 and the fourth wall 136 of the housing 106, each of the walls 230, 232, 234, 236, 238, 240 of the housing 206 may include a corrugated panel 254 with alternating grooves 256 and ridges 258—only a single set of alternating grooves and ridges is marked on the third wall 234 for clarity and ease in understanding. The discussions pertaining to the alternating grooves 256 and the ridges 258 may be applied to each alternating groove and ridge on the third wall 234. Moreover, these discussions may also be applicable to each corrugated panels disposed on each of the remaining walls 230, 232, 236, 238, 240. It may be noted that a cross-section of each alternating groove 256 of the corrugated panel 254 may be trapezoidal in shape. In detail, each alternating groove 256 may include a base wall 268 and a pair of side wall 270, 272, similar to the structure of the third wall 134 and the fourth wall 136. Further, each alternating ridge 258 of the corrugated panel 254 may include a raised wall 278. Each side wall 270, 272 may make an included, obtuse angle with the base wall 268 such that a mouth 280 of each alternating groove 256, defined between any two successive raised walls 278 of the third wall 234, has a width, $W_1$, larger than a width, $W_2$, of the base wall 268.

The housing 206 includes a frame 294 to which the walls 230, 232, 234, 236, 238, 240 are attached. The frame 294 is formed by a number of beams 296 that are interlinked to define and impart the box-shaped structure to the housing 206. Each beam 296 may include a square shaped cross-section (see FIG. 6). Each raised wall 278 includes one or more extended sheet metal portions, or simply extension portions 274 that may overlap and couple to a portion of the frame 294 (or to a beam 296 of the frame 294). In an embodiment, the extension portion 274 is welded to the frame 294, although several other known means of fastening may be contemplated, including bolting, riveting, etc. Moreover, the extension portion 274 may include a bent edge 276 (see exemplary marking on a ridge 258' of the second wall 232) to wrap around and engage the frame 294. As with the housing 106, the housing 206 may also include one or more lift hooks 286 coupled to the frame 294, as shown. Moreover, the housing 206 includes a number of mounting brackets 292, coupled to frame 294, and arranged on the housing 206 in a manner similar to the arrangement of the mounting brackets 192 described for the housing 106.

Figure 7:
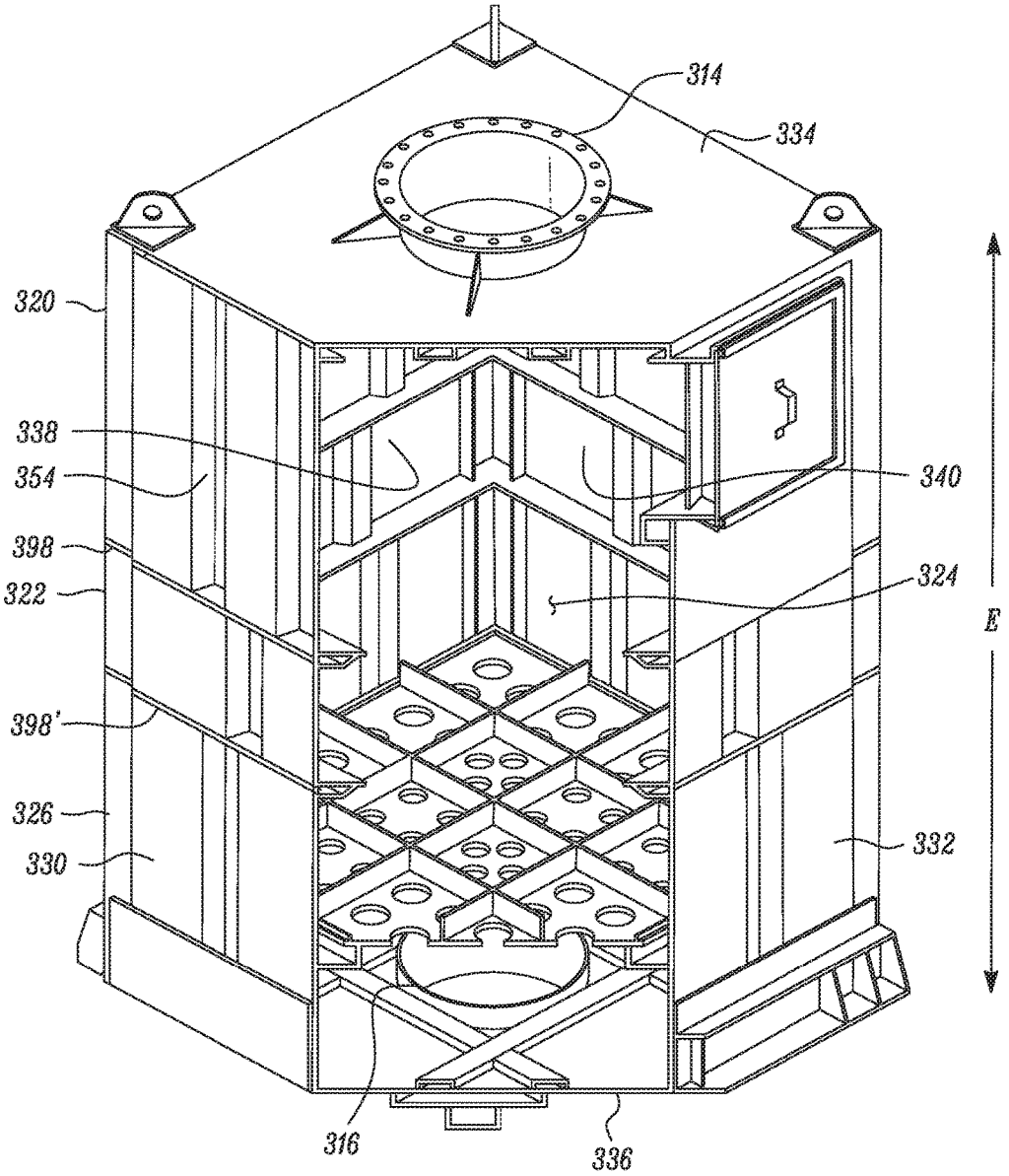
FIG. 7 is yet another embodiment of the housing, in accordance with the concepts of the present disclosure.

Referring to FIG. 7, yet another embodiment of the aspects of the present disclosure is depicted and discussed. FIG. 7 is a housing 306, which may be similar to the housings 106, 206 discussed above. As with the housings 106, 206, the housing 306 also includes a first wall 330, a second wall 332, a third wall 334, a fourth wall 336, a fifth wall 338, and a sixth wall 340. An arrangement of each of the walls 330, 332, 334, 336, 338, 340 may remain similar to and correspond to the arrangement of the walls 130, 132, 134, 136, 138, 140 discussed above. Similar to the housing 106, the housing 306 may have an inlet 314 for the exhaust gas provided in the third wall 334, an outlet 316 for the exhaust gas provided in the fourth wall 336, and an interior cavity 324 to house one or more components, such as component 108. While, the third wall 334 and fourth wall 336 may function without a corrugated panel, each of the remaining walls (i.e. the first wall 330, second wall 332, fifth wall 338, and the sixth wall 340) may include a corrugated panel 354 (see exemplary marking on the first wall 330). The corrugated panel 354 may be similar in structure to the corrugated panels 154 discussed above. However, a layout of the walls (i.e. first wall 230, second wall 232, fifth wall 338, and sixth wall 340) may differ. For example, each of the walls 330, 332, 338, 340 may be divided into multiple sections. For example, three sections may be defined across an expanse or a length (or elevation, E) of the walls 330, 332, 338, 340, as shown. The three sections may be categorized into a first section 320, a second section 322, and a third section 326—only references to the first wall 330 is provided for clarity and ease in understanding. It will be understood that such references and details may be applicable for each of the other walls (i.e. the second wall 332, the fifth wall 338, and the sixth wall 340) as well. Each of the sections 320, 322, 326 may be formed from a dedicated, single layer of sheet metal, and may include respective corrugated panels, such as the corrugated panel 354. Further, the first wall 330 may include a set of plate strips, referred to as a first plate strip 398 and a second plate strip 398'. The plate strips 398, 398' may be positioned respectively in between sections 320, 322 and sections 322, 326. The sections 320, 322 may be coupled to each other by being welded to the plate strip 398 at one juncture, while sections 322, 326 may be coupled to each other by being welded to the plate strip 398' at another juncture, in turn forming a unitarily fabricated first wall 330. The first plate strip 398 may form a dividing interface between the first section 320 and the second section 322 and the second plate strip 398' may form a dividing interface between the second section 322 and the third section 326. Although welding is disclosed as a means of fastening the sections 320, 322 and 322, 326 together, other conventionally known and well applied fastening means may be used.

According to the embodiment depicted in FIG. 7, a division of the walls, such as of the first wall 330 into sections 320, 322, 326, may be contemplated when the walls 330, 332, 338, 340 are required to be relatively large, wide, or high. This embodiment may be applicable if a strength imparted by a unitarily formed wall may fail to effectively take a load of vibrations resulting from the engine 102's firing frequency.

INDUSTRIAL APPLICABILITY

The forthcoming disclosure is discussed with reference to the housing 106 alone. Nonetheless, it will be understood that these discussions will be applicable to the housings 206 and 306 as well.

During operations, the engine 102 may produce relatively large pressure waves and pulsations because of the engine's firing frequency. Given that such large pressure waves, pulsations, and/or resulting vibrations, may lead to fatigue, deformation, and even failure of the housing 106, the walls 134, 136 of the housing 106 are provided with the corrugated panel 154. The corrugated panel 154 formed on the walls 134, 136 of the housing 106 serve as stiffeners or reinforcements that prevent the walls 134, 136 from collapse and against other ill effects of pulsations. This is because a load or the effects of pulsations sustained by the walls 134, 136 may be well distributed and absorbed by such reinforcements, given that the reinforcement are in the form of integrated stiffeners and that the entire area of each of the walls 134, 136 forms a parent material, thus yielding a stiffer, stronger wall structure. These principles may be equivalently applied to the each of the walls 230, 232, 234, 236, 238, 240 of the housing 206, and to each of the walls 330, 32, 338, 340 of the housing 306.

Further, a conventional bulky and complex practice involving the addition of layers over the walls to stiffen the walls with skins and outer walls may be considerably mitigated. Moreover, time, effort, and resources required for procuring and incorporating the outer skins, may be avoided, thus leading to easy assembly, disassembly, and service. Although various embodiments have been described that cover the use or corrugated panels on the walls, such as the first wall 130, it may be well understood that a housing in aftertreatment systems, such as the one disclosed, may use corrugated panels according to a requirement in actual condition. Therefore, certain housings may include corrugated panels applied to solely a single housing wall, while in certain conditions each wall of the housing may include a corrugated panel.

It should be understood that the above description is intended for illustrative purposes only and is not intended to limit the scope of the present disclosure in any way. Thus, one skilled in the art will appreciate that other aspects of the disclosure may be obtained from a study of the drawings, the disclosure, and the appended claim.

What is claimed is:

1. A housing for an aftertreatment system, the housing comprising:

a plurality of single-layer, rectangular, exterior walls defining a generally rectangular interior cavity configured to enclose at least one aftertreatment component, at least one of the exterior walls comprising at least one corrugated panel having alternating grooves and ridges; and a frame formed by a plurality of beams, the frame supporting the plurality of exterior walls, wherein each alternating ridge of the at least one corrugated panel includes a raised wall, the raised wall including one or more extension portions that extend in opposite directions from each other, each said extension portion overlapping and contacting a corresponding one of the plurality of beams, wherein at least one of the extension portions overlaps and contacts at least two sides of one of the beams of the plurality of beams of the frame, wherein said at least one extension portion includes a bent edge that wraps around and engages said one of the beams, and wherein the raised wall extends from one side of the exterior wall to the other side of the exterior wall opposite the one side.

2. The housing of claim 1, wherein the at least one corrugated panel is integrally formed with the at least one of the exterior walls.

3. The housing of claim 1, wherein the at least one corrugated panel runs along one of a length or a breadth of the at least one of the exterior walls.

4. The housing of claim 1, wherein each alternating groove of the at least one corrugated panel is U-shaped including a base wall and a pair of side walls, and wherein for each alternating ridge of the at least one corrugated panel the raised wall is spaced apart from the base wall.

5. The housing of claim 4, wherein the base wall is parallel to the raised wall and the pair of side walls is at right angles to each of the base wall and the raised wall.

6. The housing of claim 1, wherein each beam of the plurality of beams includes a square shaped cross-section.

7. The housing of claim 1, wherein one of the exterior walls forms a ceiling of the housing and another of the exterior walls forms a floor of the housing, wherein said one exterior wall forming the ceiling includes a first input/output port and said another exterior wall forming the floor includes a second input/output port.

8. The housing of claim 1, wherein the first input/output port is offset from the second input/output port in a top plan view of the housing.

9. An aftertreatment system for an engine, comprising:

at least one aftertreatment component; and a housing configured to house the at least one aftertreatment component, the housing having:

a plurality of walls defining an interior cavity configured to enclose the at least one aftertreatment component, a subset of the plurality of walls each having at least one corrugated panel, and a frame formed by a plurality of beams, the frame supporting the plurality of walls, wherein the at least one corrugated panel includes alternating grooves and ridges, and wherein each alternating ridge of the at least one corrugated panel includes a raised wall, the raised wall including one or more extension portions, each said extension portion overlapping and contacting a corresponding one of the plurality of beams, and wherein at least one of the one or more extension portions includes a first bent edge that wraps around and engages a first beam of the plurality of beams of the frame and a second bent edge opposite the first bent edge that wraps around and engages a second beam of the plurality of beams of the frame.

10. The aftertreatment system of claim 9, wherein the at least one corrugated panel of each wall of the subset of walls is integrally formed with the wall.

11. The aftertreatment system of claim 9, wherein the at least one corrugated panel of each wall of the subset of walls runs along one of a length or a breadth of the wall.

12. The aftertreatment system of claim 9, wherein each alternating groove of the at least one corrugated panel is U-shaped including a base wall and a pair of side walls, and wherein for each alternating ridge of the at least one corrugated panel the raised wall is spaced apart from the base wall.

13. The aftertreatment system of claim 12, wherein the base wall is parallel to the raised wall and the pair of side walls is at right angles to each of the base wall and the raised wall.

14. An engine system comprising:

an aftertreatment system configured to receive exhaust gas from an engine, the aftertreatment system including:

at least one aftertreatment component; and a housing configured to house the at least one aftertreatment component, the housing having:

a plurality of single-layer walls defining an interior cavity configured to enclose the at least one aftertreatment component, at least one of the walls having at least one corrugated panel, and a frame formed by a plurality of beams, the frame supporting the plurality of walls, wherein the at least one corrugated panel includes alternating grooves and ridges, wherein each alternating ridge of the at least one corrugated panel includes a raised wall, the raised wall including extension portions that extend in opposite directions from each other, each said extension portion overlapping and contacting a corresponding one of the plurality of beams, and wherein at least one of the extension portions includes a bent edge that wraps around and engages one of the beams of the plurality of beams of the frame.

15. The engine system of claim 14, wherein each alternating groove of the at least one corrugated panel is U-shaped including a base wall and a pair of side walls, the pair of side walls being at right angles to the base wall, and wherein for each alternating ridge of the at least one corrugated panel the raised wall is parallel to the base wall.

* * * * *